United States Patent [19]

Pezzoli

[11] Patent Number: 4,777,989

[45] Date of Patent: Oct. 18, 1988

[54] GUIDE MEANS FOR WEFT-CARRYING GRIPPERS AND GRIPPER STRAPS OF LOOMS

[75] Inventor: Luigi Pezzoli, Leffe, Italy

[73] Assignee: Vamatex S.p.A., Villa Di Serio, Italy

[21] Appl. No.: 129,887

[22] Filed: Nov. 18, 1987

Related U.S. Application Data

[63] Continuation of Ser. No. 77,039, Jul. 20, 1987, abandoned, which is a continuation of Ser. No. 869,969, Jun. 2, 1986, abandoned.

[30] Foreign Application Priority Data

Jun. 4, 1985 [IT] Italy ..... 21005 A/85

[51] Int. Cl.[4] ..... D03D 47/00

[52] U.S. Cl. ..... 139/449

[58] Field of Search ..... 139/440, 441, 442, 443, 139/444, 445, 446, 447, 448, 449

[56] References Cited

U.S. PATENT DOCUMENTS 2,151,085 3/1939 Dewas ..... 139/449

FOREIGN PATENT DOCUMENTS 46998 7/1966 German Democratic Rep. ..... 139/449

*Primary Examiner*—Henry S. Jaudon

*Attorney, Agent, or Firm*—Young & Thompson

[57] ABSTRACT

Improved structure for guiding the weft-carrying grippers and their control straps through the shed of gripper looms comprises a single plurality of guide elements (3) aligned on the sley (1), each element (3) being provided with at least two distinct seats (4, 5) for housing respectively the strap (6) and the gripper (8), the seat (5) housing the gripper (8) being apt to prevent—either by itself or in cooperation with the seat (4) for the strap (6)—any lateral or upward movements of said gripper (8).

2 Claims, 2 Drawing Sheets

GUIDE MEANS FOR WEFT-CARRYING GRIPPERS AND GRIPPER STRAPS OF LOOMS

This application is a continuation of application Ser. No. 077,039, filed July 20, 1987, now abandoned, which is a continuation of Ser. No. 869,969, filed June 2, 1986, now abandoned.

BACKGROUND OF THE INVENTION

The present invention relates to improved means for guiding the weft-carrying grippers and their control straps through the shed of gripper looms.

In the technique of weaving machines, there are known to be various systems for guiding through the shed the weft-carrying grippers and the straps controlling the same. A first system provides for a single plurality of guide elements, aligned parallel to the reed, which guide merely the straps, only on one side thereof facing the reed, with the considerable advantage of stressing the warp yarns to a very limited extent, but with the drawback of having to adopt different precautions—not always acceptable—like the use of rigid straps for controlling the grippers, and a careful choice in the distribution of the masses in the grippers in order to guarantee an efficient and reliable weft yarn exchange between the two grippers. With this system, it is moreover necessary to use a precision-machined reed, mounted very precisely, as the reed cooperates with said elements in guiding the straps and the grippers, this involving structural complications and cost increases.

A second system provides for two pluralities of guide elements, aligned on two rows parallel to the reed and guiding the straps on both sides, but with the drawback of heavily stressing the yarns being woven. In fact: the guide elements next to the reed determine greater deviations of the warp yarns which facilitate stresses and breaking; the weft yarns may get caught in said elements and consequently break; the warp yarns may get caught in the strap and in the guide elements (especially when they are loose, as in the case of weaving highly beaten articles) with consequent stresses and breaking.

In any case, in all the known systems, the guide elements house into a single seat thereof, and engage with the same surfaces, either only the straps—as in the aforementioned examples—or, if desired, the straps and projections of the grippers positioned like extensions of said straps.

SUMMARY OF THE INVENTION

The present invention proposes to eliminate the drawbacks of such systems, while preserving their advantages, by providing means for guiding the weft-carrying grippers and their control straps through the shed of gripper looms, characterized in that they comprise a single plurality of guide elements aligned on the sley, each element being provided with at least two distinct seats for housing respectively the strap and the gripper, the seat housing the gripper being apt to prevent—either by itself or in cooperation with the seat for the strap—any lateral or upward movements of said gripper.

According to the invention, the weft-carrying grippers comprise—for their introduction into the seats of said guide elements—tongues or projections having a shape complementary to that of said seats.

Preferably, the seats of said guide elements housing both the grippers and the straps appear, as a whole, like grooves or openings forming guide structures through the shed.

BRIEF DESCRIPTION OF THE DRAWINGS

The invention is now described in further detail, by mere way of non-limiting example, with reference to the accompanying drawings, in which.

DESCRIPTION OF THE PREFERRED EMBODIMENTS

Figure 1:
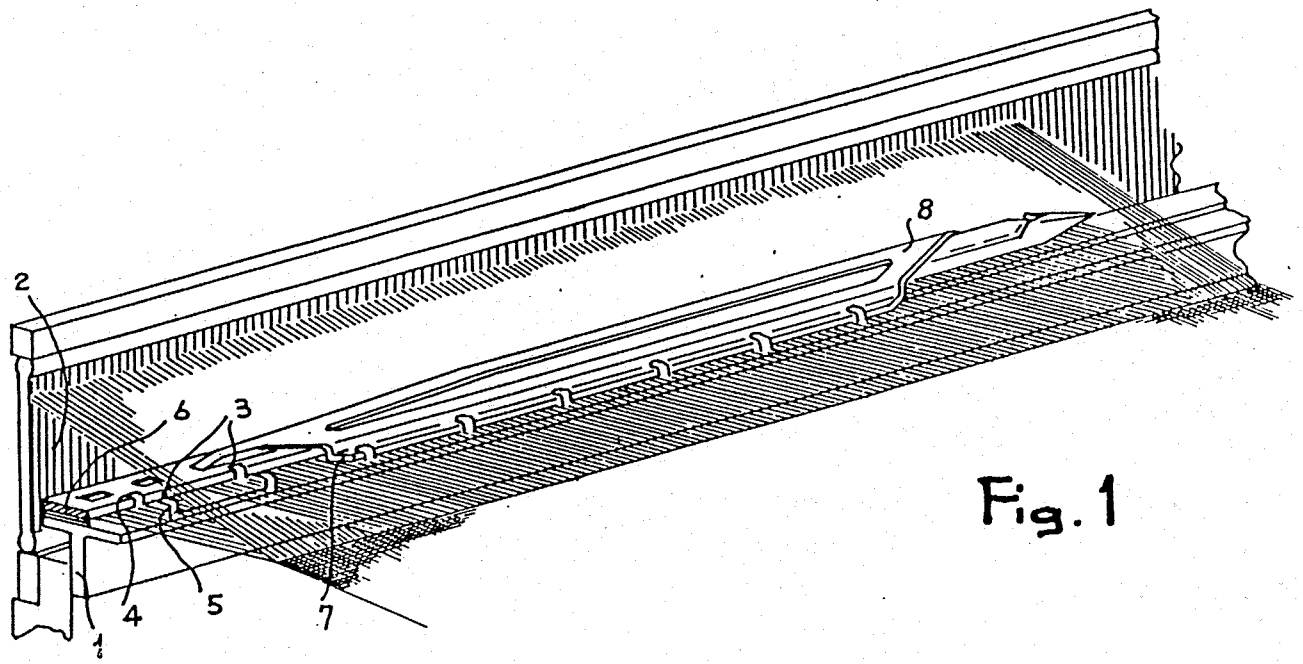
FIG. 1 is a general perspective view of the improved arrangement according to the invention.

As shown in FIG. 1 of the drawings, the guide means according to the invention comprise—on the sley 1 of a gripper loom, of which also the reed 2 is illustrated—a plurality of guide elements 3, aligned on a single row parallel to the reed 2 and each comprising at least two distinct seats 4 and 5, the first seat being apt to house the gripper strap 6 and the second seat housing a tongue 7 of the gripper 8. The assembly of said guide elements 3 with the seats 4 and 5 is apt to form guide structures, parallel to the reed 2, engaging separately the strap 6 and, with precision, the tongue 7 of the gripper 8, so that the gripper itself may move forward and backward, parallel to and spaced from the reed 2, without undergoing lateral or upward shifting.

The guide elements 3 and their seats 4 and 5 may have different structures, of which some examples are given hereinafter.

Figure 2:
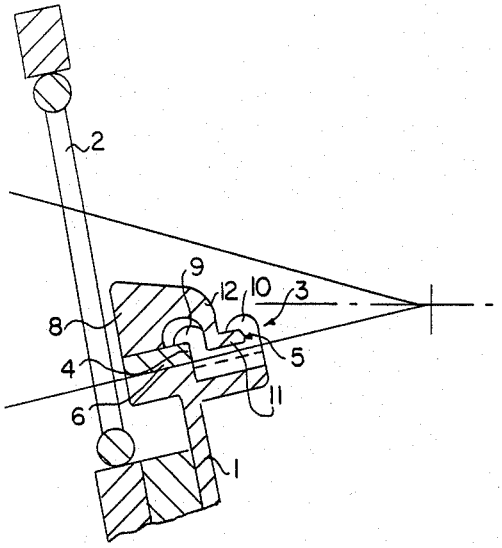
FIGS. 2, 3, and 4 are detailed cross sectional views of three respectively different embodimenets of the guide elements forming the improved arrangement according to the invention.

In FIG. 2, the seats 4 and 5 of the guide elements 3 are formed by a pair of aligned hooks 9 and 10, facing the reed 2: the strap 6 is freely housed under the first hook 9 closer to the reed, while the seat which the second hook 10 forms with the shoulder of the first hook allows the tightly guided introduction of a horizontal tongue 11, laterally projecting from the body of the gripper 8 to which it is connected at the top in 12, the shape of said tongue 11 being complementary to that of the seat 5. FIG. 2 shows how the body of the gripper 8 moves parallel to the reed 2, but well spaced therefrom.

Figure 3:
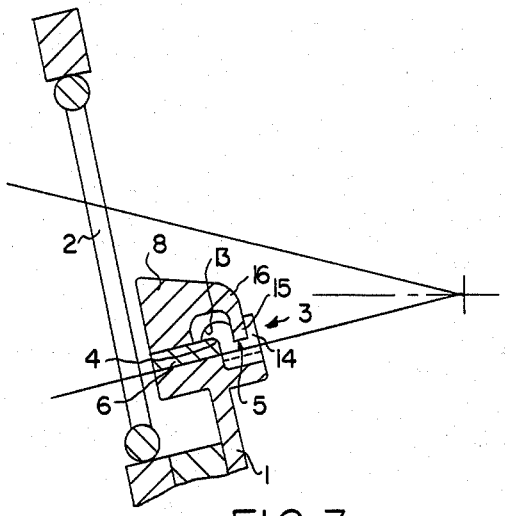

In FIG. 3', the guide elements 3 comprise a hook 13 facing the reed 2, which creates the seat 4', and a substantially vertical groove 14, formed on the backside of the hook 13, which creates the seat 5'. Said seats are apt to house the strap 6 and an extension or tongue 15 of the gripper body 8' formed as a vertical tongue projecting from the side of said body and connected therewith at the top in 16.

Figure 4:
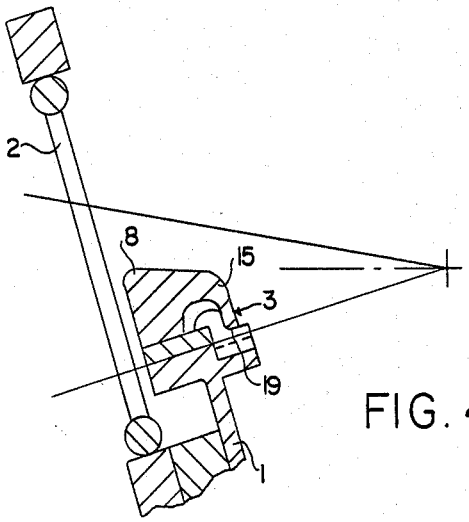

FIG. 4 shows a variant of the solution of FIG. 3, wherein the groove housing the vertical tongue 15 of the gripper 8 has been reduced to an undercut 19.

It will thus be seen that the present invention provides a gripper loom having a sley 1 to which a reed 2 is fixed having a reed face parallel to the sley as seen in FIGS. 2–4. The strap 6 is displaceable parallel to the sley 1, and the weft gripper 8 is fixed to the strap. The weft gripper comprises a body which includes a tongue 11, 15. As can also be seen in FIGS. 2–4, the strap 6 and weft gripper 8 fixed thereto and the sley 1 are all spaced from the face of reed 2.

As is also apparent from FIGS. 2–4, a plurality of guide means 3, 3', 3'' are fixed at intervals to the sley 1 only on the side of the strap 6 and weft gripper 8 which is opposite the face of reed 2. Each of these guide means cooperatively guides the strap 6 by overlying the edge of the strip which is remote from the reed face, during displacement of the strap parallel to the sley. The tongue 11, 15 is disposed on the upper side of the body of gripper 8 and has a guiding portion 12, 16 extending away from the face of reed 2 over the guide means 3, 3', 3'' and then downwardly along the side of the guide means opposite the reed face, so as to prevent movement of the strap 6 and gripper 8 in a direction perpendicular to the direction of displacement of the strap 6.

It is further apparent from FIGS. 2–4, that the strap 6 is edgewise unconfined between itself and the face of reed 2, and that the sley underlies and slidably supports the strap substantially full width of the strap on a surface of the sley that is perpendicular to and spaced from the reed face.

The guide means are in the form of hooks that extend upward from the sley and are bent over and overlie the edge of the strap remote from the reed face.

It is understood that there could be many other embodiments of the invention, particularly for what concerns the shape of the seats for the straps and for the grippers, and the tongue or extension of the gripper body housed into the seat.

Any of the heretofore described and illustrated embodiments of the guide means are apt to fulfil the objects of the present invention, in that:

the guide elements are constructed and arranged so as to exclude all possibility of weft or warp yarns getting caught therein;

the guide elements, and especially their parts cooperating with the grippers, are positioned far from the reed, whereby the warp yarns are not forced into any sharp deviations with the risk of getting caught;

the gripper is perfectly guided through the shed, thanks to the wide extension of the surface of mutual contact between the gripper body and its guide element and to the configuration of said surface, and also thanks to the cooperation—for guiding purposes—obtained through the corresponding simultaneous introduction of the strap into the seat of the guide element provided therefor;

any rubbing of the grippers and their control straps against the reed is thereby avoided;

the reed performs no guiding function, whereby the mounting and machining thereof need not be specifically accurate.

I claim:

1. A gripper loom having a sley to which a reed is fixed having a face parallel to the sley, a strap displaceable parallel to said sley, and a weft gripper fixed to said strap, said weft gripper comprising a body which includes a tongue, said strap and said weft gripper fixed thereto being spaced from said reed face, a plurality of guide means fixed at intervals to said sley only on the side of the strap and weft gripper which is opposite said reed face, each said guide means cooperatively guiding said strap by overlying the edge of the strap remote from said reed face during displacement of said strap parallel to said sley, said tongue being disposed on the upper side of said body and having a guiding portion extending away from the reed face over the guide means and then downwardly along the side of the guide means opposite the reed face so as to prevent movement of said strap and said weft gripper in a direction perpendicular to said direction of displacement, the strap being edgewise unconfined between the strap and the reed face, the sley underlying and slidably supporting the strap substantially full width of the strap on a surface that is perpendicular to and spaced from the reed face.

2. A gripper loom as claimed in claim 1, in which said guide means are in the form of hooks that extend upward from the sley and are bent over and overlie said edge of the strap remote from the reed face.

* * * * *